United States Patent [19]

Hamilton et al.

[11] Patent Number: 4,939,705

[45] Date of Patent: Jul. 3, 1990

[54] DRUG DISPENSING EVENT DETECTOR

[75] Inventors: Richard G. Hamilton, Fremont; David M. Liu, Los Altos, both of Calif.

[73] Assignee: Aprex Corporation, Fremont, Calif.

[21] Appl. No.: 275,294

[22] Filed: Nov. 23, 1988

[51] Int. Cl.[5] ..... G04B 47/00; G07F 11/00

[52] U.S. Cl. ..... 368/10; 368/108; 221/2

[58] Field of Search ..... 368/10, 107–113; 221/2, 3, 15; 340/309.15, 309.4; 364/569

[56] References Cited

U.S. PATENT DOCUMENTS

| | | | |
|---|---|---|---|
| 4,034,757 | 7/1977 | Glover | 128/260 |
| 4,367,955 | 1/1983 | Ballew | 368/10 |
| 4,382,688 | 5/1983 | Machamer | 368/10 |
| 4,419,016 | 12/1983 | Zoltan | 368/10 |
| 4,448,541 | 5/1984 | Wirtschafter | 368/10 |
| 4,504,153 | 3/1985 | Schollmeyer et al. | 368/10 |
| 4,588,303 | 5/1986 | Wirtschafter et al. | 368/10 |
| 4,682,299 | 7/1987 | McIntosh et al. | 364/569 |
| 4,695,954 | 9/1987 | Rose et al. | 364/413 |
| 4,768,176 | 8/1988 | Kehr et al. | 368/10 |

*Primary Examiner*—Vit W. Miska
*Attorney, Agent, or Firm*—Irell & Manella

[57] ABSTRACT

A device for detecting the dispensing of drugs from a container in a way which eliminates false detection events due to mishandling of the container is disclosed. The device includes a container which may be opened and closed. It also contains a means for detecting the opening and separately detecting the closing of the container as well as means for measuring the time between these events and comparing this elapsed time to a predetermined standard indicative of drug dispensing event. The times of proper drug dispensing events are stored in the device for use by the health care professional following the patient's drug dosing compliance. Other opening and closing intervals which fall outside this time range give rise to an alternative response. They may be recorded with a notation of their probable error or they may be disregarded. In other aspects, the invention provides a preferred physical configuration for the electronic components of the device and a preferred means for accessing the data stored in the device.

9 Claims, 3 Drawing Sheets

DRUG DISPENSING EVENT DETECTOR

BACKGROUND OF THE INVENTION

2. Field of the Invention

This invention relates to a device for monitoring the dispensing of medication to patients. More particularly it relates to a system for accurately detecting drug dispensing events.

2. Description of the Prior Art

A variety of devices and methods have been described for controlling, noting, and keeping track of dispensation of medicines to patients. These devices range from simple mechanical checklist systems, through pill containers equipped with alarm clocks and the like and pill containers having timer-controlled latching devices which regulate the patient's access to medication. Some typical examples of these devices include the timed medication dispenser described by Roy J. Machamer in U.S. Pat. No. 4,382,688 which shows a medical dispenser having an electronic reminder to take the medication it contains. In this device the electronic reminder is disabled when the user takes the medication. In U.S. Pat. No. 4,448,541, Jonathan D. Wirtschafter describes a magnetically responsive switch device which is activated when a medication dispenser is opened so as to give an indication of the drug dispensing event. U.S. Pat. No. 4,367,955 of Donald H. Ballew shows a combined timer and container for dispensing medications wherein the container and its lid coact to initiate the timer cycle upon interengagement of the cap and container. U.S. Pat. No. 4,034,757 of Glover shows a device having two switches, each of which must be activated simultaneously to register a drug delivery event.

The foregoing patents are merely representative. Other background patents relating to medication dispensers include for example U.S. Pat. Nos. 3,369,697 of Glucksman et al.; 3,395,829 of Cogdell et al.; 3,651,984 of Redenback; 3,722,739 of Blumberg; 3,762,601 of McLaughlin; 3,815,780 of Bauer; 3,911,856 of Ewing; 3,917,045 of Williams; 3,968,900 of Stambuk; 3,998,356 of Christensen; 4,207,992 of Brown; 4,223,801 of Carlson; 4,258,354 of Carmon et al.; 4,275,384 of Hicks et al.; 4,360,125 of Martindale et al.; 4,361,408 of Wirtschafter; 4,382,688 of Machamer; 4,419,016 of Zoltan; 4,448,541 Wirtschafter; 4,473,884 of Behl; 4,483,626 pof Nobel; 4,490,711 of Johnston; 4,504,153 of Schollmeyer et al. and 4,526,474 of Simon.

In the case of devices with which it is desired to monitor access to a multidose drug container it is of importance to be able to identify true access events and distinguish them from false events. A true event would include opening the container, removing a pill or other medicament and then closing the container. A false event could include leaving the container open and repeatedly removing pills or, in the case of the not-sure-handed, repeated attempts at reinstalling the cap after a single removal of a drug or dropping the closed container, thereby actuating the open-close switch by means of the force of impact.

It is an object of this invention to provide a detection system which will be capable of identifying true drug removal events and discriminating them from these false events.

It is important that a device capable of electronically identifying and recording drug dosing information be constructed in a manner which is sturdy and reliable. It is also important that the construction be such as to minimize even inadvertent contact between the medication contained in the device and the various electronic elements which note and record the dosing information. This avoids contamination of the drug by contact with the electronic component, on the one hand, and interference with the proper functioning of the electronics by contact with the drug, on the other. The construction should also minimize cost and advantageously permit reuse of expensive electronic components. To these ends, it is a further object of this invention to provide a device for measuring and recording drug dosing information which physically separates the majority of the electronic components from the drug storage chamber. It is also an object of this invention to provide a device in which major electronic components can be recycled.

STATEMENT OF THE INVENTION

In accord with the present invention, a device is provided which is capable of discriminating between true and false drug dispensing events. This device includes a drug container having an openable and reclosable cap, lid or other similar dispensing aperture. The container is equipped with a detector which generates a first electrical signal in response to the opening of the dispensing aperture and a second electrical signal in response to the reclosing of the aperture. The device additionally includes a timing mechanism which measures the time elapsed between the first electrical signal and the second electrical signal. The elapsed time is then compared to a predetermined accept/reject standard. Times shorter than the accepted range, and thus indicative of fumbling with the cap or an impact event, are rejected. In preferred embodiments times longer than the accepted range and thus indicative of an open container can also be rejected. In other embodiments the device can measure the time between a closing and the next opening and compare that period to a standard to validate a drug dispensing event. A time meeting the preset criteria, such as falling within the desired range, is considered to be a good indication of a true drug-dispensing event. The device further includes a system for using these indications of true drug-dispensing events. This system of use can include a memory for storing the number of such events. It can also include a timekeeping mechanism which can provide and record the time and date each time an elapsed time within the accept range is determined. The information so determined and stored can be accessed by the pharmacist, physician or other health care professional as needed to verify compliance with dosing regimens, to give an indication of the patient's condition, or the like. In alternative embodiments, the determination that an elapsed time has fallen outside the accept range can be used to activate an alarm, to deliver a message to the patient or to the patient's health care professional or to alter the delivery pattern of drugs from the device such as by disabling the ability of the device to deliver drug or the like.

In other aspects, this invention provides an improved construction for an electronic medication monitor. In this preferred construction, the electronics are present in a removable cap for a medication container. In this construction all the electronics, except for a switch, are isolated from the drug container so that contamination between the electronics and the drug is avoided. In other aspects, the electronics are positioned so that expensive components may be removed and recycled.

In yet a further aspect, the device of this invention can include an electronic access port through which data and program information is loaded and off-loaded wherein this access port is in the form of a plurality of electrically conductive pads which are accessed by spring-loaded pins in a suitable probe.

DETAILED DESCRIPTION OF THE INVENTION

BRIEF DESCRIPTION OF THE DRAWINGS

The present invention will be further described with reference being made to the accompanying drawings in which.

Description of Preferred Embodiments

Figure 1:
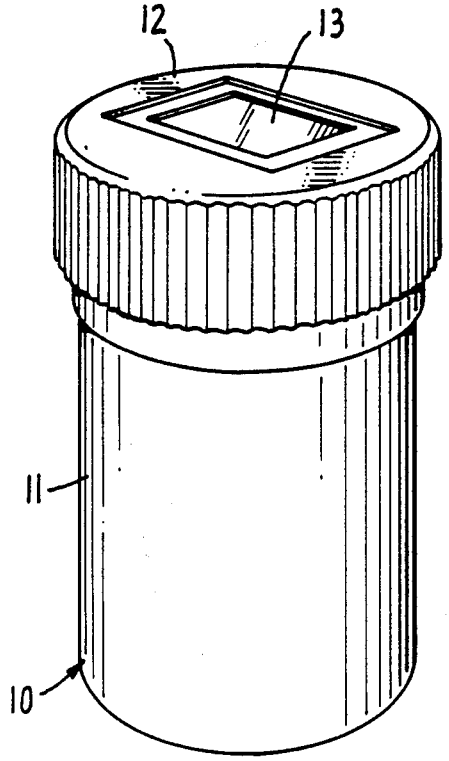
FIG. 1 is a perspective elevational view of a pill container incorporating the present invention.
Figure 2:
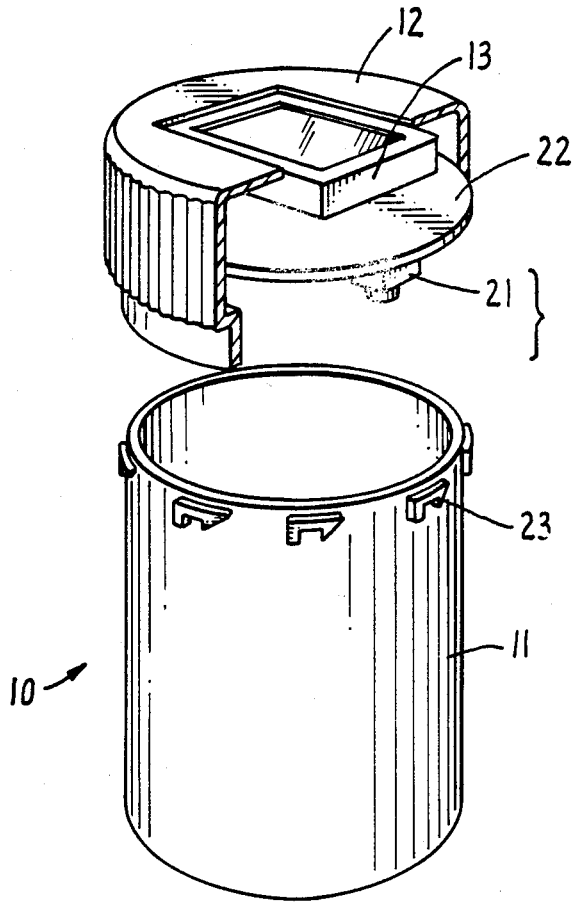
FIG. 2 is a cutaway of the device shown in FIG. 1.

Turning first to the drawings, In FIGS. 1 and 2, a drug container 10 is illustrated as including a pill vial 11 and removable/reclosable cap 12. Cap 12 serves as a drug access port and in the embodiment shown additionally includes an optional optical readout 13 which can be used to display messages, signals or the like. Container 10 can take on a variety of configurations. It can be a dry pill container, as shown, a fluid drug container with a removable or openable cap, an aerosol with its dispensing nozzle carried under a removable/replaceable cover, or the like. In any embodiment, device 10 includes means for noting opening and closing of the drug access port. This can take the form of switch 21 which is physically engaged when the top 12 is placed on vial 11 and which is disengaged when it is removed. Of course, other functionally equivalent magnet switches or the like could be used so long as they give an accurate indication of the opening and the closing of the drug container. The output of switch 21 is fed to circuit board 22. Latching tabs 23 are used to fasten the top to the vial.

Figure 3:
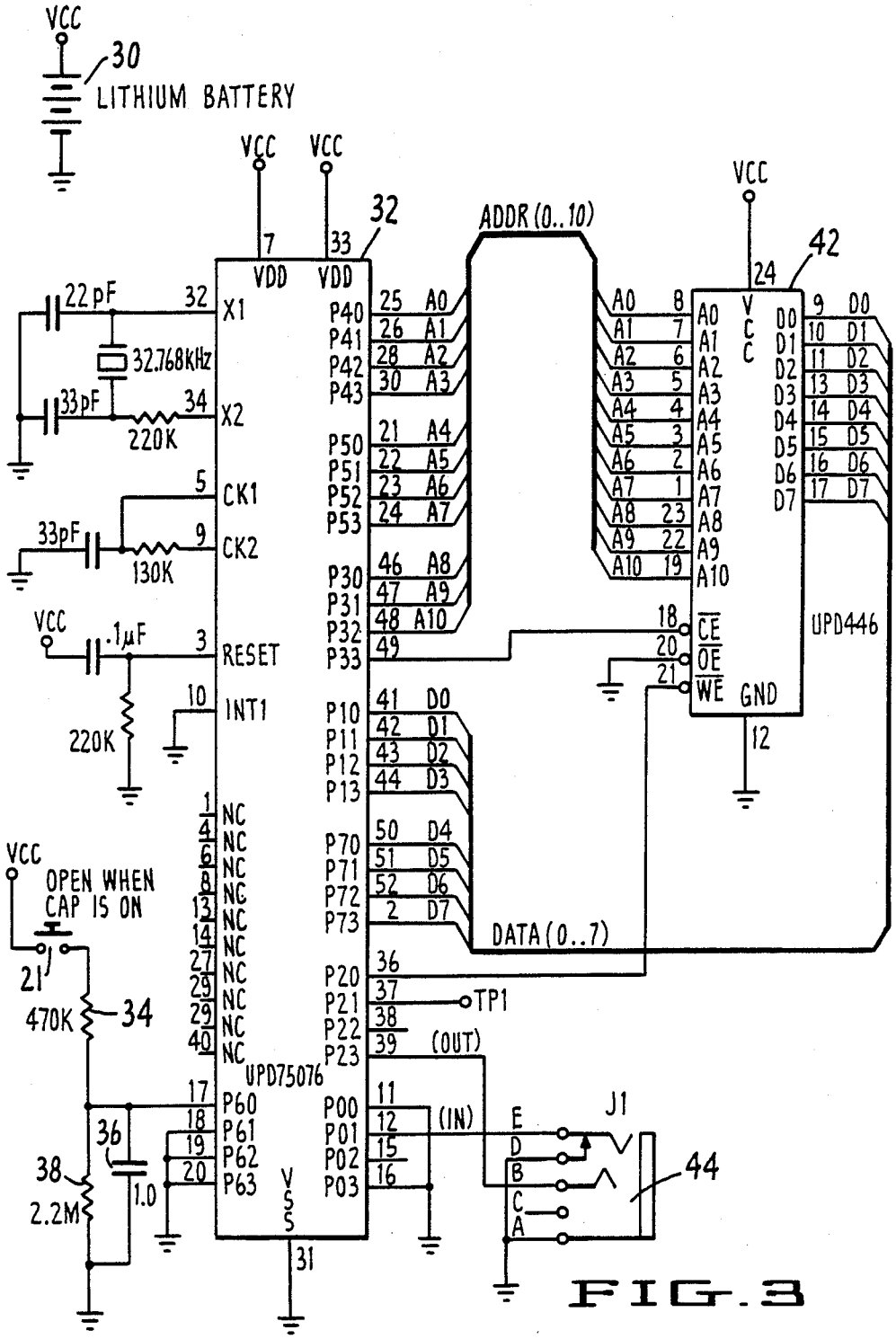
FIG. 3 is a simple circuit diagram of one form of electronics usable as part of the present invention.

The signal so generated by switch 21 is fed into an electronic circuit such as shown in FIG. 3. In FIG. 3, 3-volt power is supplied by lithium battery 30 to a variety of locations in the circuit, as noted in legend VCC. The circuit employs a general purpose microprocessor 32. A 32 kHz clock crystal frequency is fed to pins X1 and X2 of microprocessor 32.

An active analog filter, constructed to set the pair of times which validate an opening, is coupled to pin P60 of microprocessor 32. This filter functions as follows—when the cap is removed, switch 21 is closed. This sends current through resistor 34 to capacitor 36. This resistor and capacitor are matched so that it takes about 0.5 seconds for the capacitor to charge to a threshold voltage which can be read by the microprocessor. If the switch was not closed for at least this period, as would be the case with an instantaneous closing, such as if the device were dropped, an adequate charge to indicate cap removal would not be generated, and the microprocessor would not be signaled that the cap had been removed. As will be appreciated, resistor 34 and capacitor 36 can be altered in value to give other time constants, if desired.

After a "cap off" signal has been sent to the microprocessor, pin P60 remains above the threshold voltage. When the cap is replaced, eliminating the voltage source through resistor 34, capacitor 36 is drained at a set rate through resistor 38 to ground 40. The value of resistor 38 is selected in this particular case so that the voltage drains past the threshold voltage. In the circuit shown, this takes about 2 seconds. At that time, pin P60 notes that the cap has been replaced. Thus, the device provides that a valid cap closing occurs after 2 seconds. If the cap were to be jiggled back open, this would cause current to flow through switch 21 and resistor 34 to maintain pin P60 at a "cap open" voltage.

Returning to microprocessor 32, it is a general purpose which contains an internal clock function. It also contains a small amount of RAM and about 2K of 8-bit ROM. This contains custom code which is used to communicate with RAM memory 42 drug delivery information generated by the actuation of switch 21 and filtered with the validation circuit is stored in RAM 42 together with time information supplied by microprocessor 32. This information is accessible through data point 44. It may be used by the health care professional to determine dosage times so as to validate correct dosing or to determine incorrect dosing.

The time interval between opening and reclosing the top of drug container 10 has been shown to be measured and compared to a predetermined standard. In the case shown, if the time between the two events is shorter than about 0.5 seconds, the system logic determines that in fact the top was not removed and a drug dose was not dispensed simply because that time was too short. This event would be classed as an inadvertent or error signal. No indication of drug dosing would be noted. Similarly, if the time interval between the closing and the subsequent opening is too short, for example, less than about 2 seconds, the device will not register the event as a true closing of the device and instead record the event as a mere fumbling with the cap or the like. The device can additionally be equipped to compare the interval between a valid opening and valid closing an provide an indication as to whether or not this interval is consistent with a single dosing or not. Too long an interval would suggest that the device was left open for an extended period and that possibly multiple doses were taken. In a variation, the device may contain information indicating the usual time between successive doses. If the time period between a valid opening and a valid closing far exceeded the normal period of a few seconds, but rather corresponded to the period between successive doses, the device could be equipped to indicate the logical conclusion that the device was opened, a dose taken, and the device not reclosed until a subsequent time when a second dose was taken.

Correct drug dispensing events, that is a proper opening and a proper closing separated in time by a proper interval can be stored into a readable memory for use by the health care professional to verify proper dosing or to identify dosing errors. Incorrect events may in some cases be disregarded or may be noted in the memory as well, preferably with a suitable notation regarding their incorrectness, also for use by the health care professional The correct and incorrect opening and closing information can also be used on an interactive basis such as to modify the dosing regimen, to send signals to the patient or the health care professional alerting them of changes or deviations from the desired or expected regimen or the like.

Although not intended as a limitation on the structure of the device in which the present time filtering is employed, the device of FIGS. 1 and 2 can have several other useful features. These features, which find application in other drug compliance monitors, as well, are shown in FIGS. 4 through 7.

One such advantageous feature is to have a construction which separates the drug from the electronics of the medication event monitor. If the drug and electronics are allowed to come into contact with one another the drug may interfere with the electronics or the electronics may contaminate the drug such as by releasing noxious or toxic materials into the drugs. In the embodiment shown in FIGS. 4–6 the electronics are isolated in the cap of the drug dispenser. In this embodiment the cap 12 includes a cap body 41 having a continuous barrier 42. Barrier 42 has holes 43 and 43*a* through which electronic wires can be passed. The electronics employed in the device, save and except for a single switch 46 which is physically activated when the cap is removed or replaced on the drug container, are carried on a printed circuit board 45 which fits into body 41. Cap liner 48 is present shielding the switch 46 from the drug storage region. When the cap is placed on the drug container, the top lip of the container presses against the liner 48 and forces it upwards against the switch 46 causing it to open or close. The two leads on switch 46 pass through holes 43 and 43*a* and seal these holes, preferably so that there is no possible contact between the drug contained in the device with the electronics. A cap lid 49 is present covering the electronics. It is overlaid with a label 50 which can carry information about the drug, the device or the like.

Figure 4:
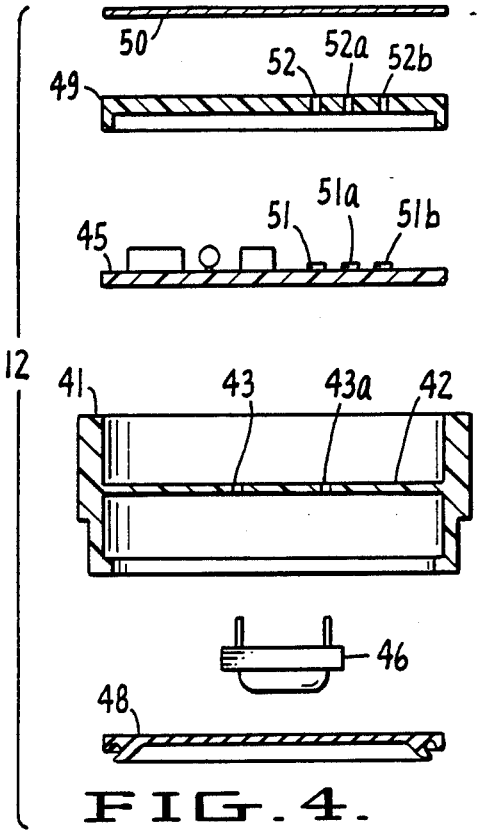
FIG. 4 is an exploded cross-sectional side view of a cap for a drug container, which cap contains the electronics necessary for noting and recording drug delivery in accord with this invention.
Figure 5:
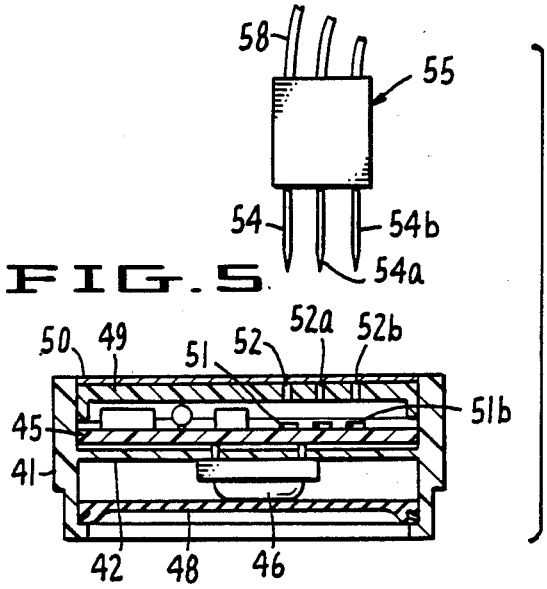
FIG. 5 is a cross-sectional side view of the cap of FIG. 4 in unexploded format.

Another useful feature of the device of this invention when configured as shown in FIGS. 4–5 is the ability to recycle electronics. The electronic circuitry employed in the present invention is relatively costly as it contains at least one general purpose microprocessor chip. While it is generally not preferred to reuse drug containers for a sequence of drugs, for fear of some risk or cross contamination, no matter how remote, it would be desirable to recycle the electronics. In the configuration shown, the single switch 46 can be uncoupled by removing two connections and then the entire electronics board, which has not been in contact with drug, can be removed and recycled.

Figure 6:
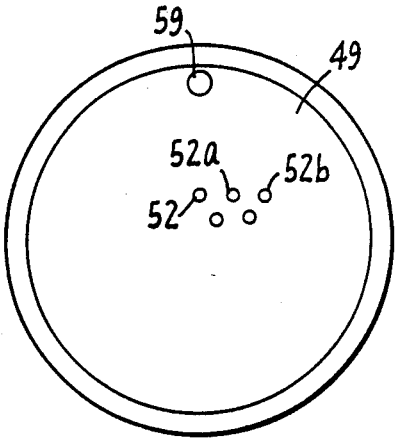
FIG. 6 is a top view of the cap of FIG. 4.
Figure 7:
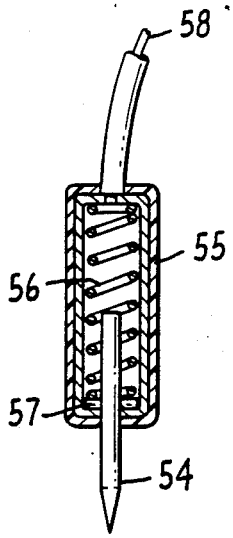
FIG. 7 is a cross-sectional view of a probe pin useful for making electrical contact with the electronic circuitry of the cap of FIG. 4 for data output or program input.

Yet an additional feature of this preferred embodiment is shown with special reference to FIGS. 6 and 7. This feature relates to the way data is extracted from the memory of the device and programs are fed into the memory of the device. One typical way to do this is to use a telephone jack or the like. A preferred method is shown in the figures where a simpler less space consumptive coupling is shown. In this embodiment the coupling is effected through a plurality of electrically conductive pads 51, 51*a*, 51*b*, etc. these are aligned with a corresponding plurality of holes 52, 52*a*, 52*b*, etc in the cap lid 49. They also correspond in position to a plurality of spring-loaded pins 54, 54*a*, 54*b*, etc in a data probe 55. In use, the pins are thrust through the label 50, through the holes 52 until the sharp ends of the pins 54 contact the conductive pads 51. The pin 54 is loaded with spring 56 and held in place by stop 57 so that a firm engagement between the pin and the pad is possible. Conductor 58 carries data from the devices memory or feed program to the device, as appropriate. FIG. 7 shows a top view of one form of hole arrangement. In the arrangement shown, there are 5 holes, arranged i a configuration which allows only a single orientation of coupling of the connector. These five holes are located in a particular position relative to registration mark 59. In actual use, the cap could be placed in an automated reader of some sort with registration mark 59 properly aligned with a corresponding position in the reader. Then the test pins 54 could automatically align with and access the conductive pads through holes 52. This configuration has the advantages of small size, and low cost.

While the invention has been described with reference being made to certain preferred embodiments, these are not to be construed as limitations on the scope of the invention which is instead as defined by the following claims.

What is claimed is:

1. A device for detecting the dispensing of drug from a container comprising a container having an openable and reclosable dispensing aperture, means capable of generating a first electrical signal in response to the opening of the openable aperture and a second electrical signal in response to the reclosing of the aperture, means for measuring the elapsed time between the first electrical signal and the second electrical signal, means for comparing the elapsed time with a predetermined accept/reject time range and determining if the elapsed time falls within the accept range, and means for recording each time an elapsed time within the accept range is determined.

2. The device of claim 1 wherein the predetermined accept/reject time range is a time range having a minimum boundary of about 0.5 seconds.

3. The device of claim 2 wherein the recording is noted as a valid dispensing of drug from the container.

4. The device of claim 1 additionally comprising means for measuring a second elapsed time between the second electrical signal and the next subsequent first electrical signal means for comparing the second elapsed time with a second predetermined accept/reject time range and determining if the elapsed time falls within that second accept range, and means for recording each time an elapsed time within the second accept range is determined.

5. The device of claim 4 wherein the second predetermined accept/reject time range is a time range having a minimum boundary of about 2 seconds.

6. The device of claim 5 wherein the recording is noted as a valid closing of the container.

7. The device of claim 4 additionally comprising means for recording openings or closings of the container which fall outside the accept range.

8. The device of claim 4 additionally comprising means for alerting the patient when the elapsed time is larger than the accept range.

9. The device of claim 4 additionally comprising means for informing the patient's health care professional when an elapsed time outside the accept ranges has been detected.

* * * * *